US009867453B1

(12) United States Patent
Diaz et al.

(10) Patent No.: US 9,867,453 B1
(45) Date of Patent: Jan. 16, 2018

(54) BACKPACK WITH INTEGRATED PILLOW AND PONCHO

(71) Applicants: Ariel Diaz, Hewlett, NY (US); Nicholas Pantelidis, Hewlett, NY (US)

(72) Inventors: Ariel Diaz, Hewlett, NY (US); Nicholas Pantelidis, Hewlett, NY (US)

( * ) Notice: Subject to any disclaimer, the term of this patent is extended or adjusted under 35 U.S.C. 154(b) by 0 days.

(21) Appl. No.: 15/333,496

(22) Filed: Oct. 25, 2016

(51) Int. Cl.

| | |
|---|---|
| ***A41D 13/00*** | (2006.01) |
| ***A45F 4/12*** | (2006.01) |
| ***A45F 3/04*** | (2006.01) |
| ***A41D 3/00*** | (2006.01) |
| ***A41D 3/08*** | (2006.01) |
| ***A41D 15/04*** | (2006.01) |

(52) U.S. Cl.
CPC ..... *A45F 4/12* (2013.01); *A41D 3/005* (2013.01); *A41D 3/08* (2013.01); *A41D 15/04* (2013.01); *A45F 3/04* (2013.01); *A41D 2200/20* (2013.01); *A41D 2400/48* (2013.01)

(58) Field of Classification Search
CPC . A45F 2004/006; A45F 2004/02; A41D 1/02; A41D 1/04; A41D 13/00
USPC ..... 224/153, 154, 576, 582
See application file for complete search history.

(56) References Cited

U.S. PATENT DOCUMENTS 2,764,327 A * 9/1956 Stevenson ..... A45F 3/04 224/236
2,783,473 A * 3/1957 Humpeler ..... A41D 15/04 2/69
4,370,755 A 2/1983 Crumby
5,165,111 A * 11/1992 Lieberman ..... A41D 15/04 2/108
5,564,125 A * 10/1996 Waldman ..... A41D 3/00 2/93
5,664,258 A 9/1997 Harris
5,673,836 A * 10/1997 Bush ..... A41D 13/00 2/94
5,779,036 A * 7/1998 Westbrook ..... A45C 3/12 190/102
5,785,219 A * 7/1998 Kraft ..... A45F 4/02 2/66
6,024,264 A * 2/2000 Java ..... A45B 3/00 135/16
6,134,712 A 10/2000 Spector
(Continued)

FOREIGN PATENT DOCUMENTS

WO 2011163082 A2 12/2011

*Primary Examiner* — Brian D Nash
(74) *Attorney, Agent, or Firm* — Kyle A. Fletcher, Esq.

(57) ABSTRACT

The backpack with integrated pillow and poncho is a travel article. The backpack with integrated pillow and poncho is a backpack that converts into both a poncho and a cushion. The poncho attaches to the backpack such that the backpack can continue to be worn while the poncho is also donned and being worn. The material used to form the poncho forms a padding material when the backpack with integrated pillow and poncho is used as the cushion. The backpack with integrated pillow and poncho comprises a first panel, a second panel, a harness, a cape, a zipper, and a plurality of seams. The cape is contained within the first panel and the second panel. The harness attaches to the first panel. The first panel, the second panel, the harness, and the cape are all interconnected using the zipper and the plurality of seams.

16 Claims, 6 Drawing Sheets

(56) References Cited

U.S. PATENT DOCUMENTS

| | | | | |
|---|---|---|---|---|
| 6,315,178 | B1 * | 11/2001 | Nobata | A45C 13/002 190/1 |
| 6,408,462 | B1 | 6/2002 | Moore | |
| 6,421,834 | B2 * | 7/2002 | Kester | A41D 15/04 2/94 |
| 7,374,071 | B2 * | 5/2008 | Lavelle | A41D 3/08 2/94 |
| 7,575,138 | B2 * | 8/2009 | Lindberg | A45C 7/0063 224/645 |
| D677,859 | S | 3/2013 | Andes | |
| 2003/0042277 | A1 * | 3/2003 | Gulmatico, III | A45C 7/0077 224/153 |
| 2003/0205593 | A1 * | 11/2003 | Lavelle | A41D 3/08 224/153 |
| 2004/0155077 | A1 * | 8/2004 | Cullen | A45C 3/10 224/153 |
| 2005/0133558 | A1 * | 6/2005 | Toombs | A45C 13/002 224/576 |
| 2008/0054032 | A1 | 3/2008 | Jones | |
| 2010/0059558 | A1 | 3/2010 | Robinson | |
| 2011/0309122 | A1 | 12/2011 | Sternlight | |
| 2016/0174633 | A1 * | 6/2016 | MacRae | A45F 4/12 2/69.5 |

* cited by examiner

BACKPACK WITH INTEGRATED PILLOW AND PONCHO

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including traveling and camping equipment, more specifically, a sack or pack carried on the body that is convertible into another object.

SUMMARY OF INVENTION

The backpack with integrated pillow and poncho is a travel article. The backpack with integrated pillow and poncho is a backpack that converts into a poncho. The backpack with integrated pillow and poncho further converts into a cushion for sitting or sleeping. The backpack with integrated pillow and poncho is worn on the back such that when the poncho is required, the backpack is opened and the poncho is removed. The poncho attaches to the backpack such that the backpack can continue to be worn while the poncho is also being worn. The material used to form the poncho forms a padding material when the backpack with integrated pillow and poncho is used as the cushion.

These together with additional objects, features and advantages of the backpack with integrated pillow and poncho will be readily apparent to those of ordinary skill in the art upon reading the following detailed description of the presently preferred, but nonetheless illustrative, embodiments when taken in conjunction with the accompanying drawings.

In this respect, before explaining the current embodiments of the backpack with integrated pillow and poncho in detail, it is to be understood that the backpack with integrated pillow and poncho is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the backpack with integrated pillow and poncho.

It is therefore important that the claims be regarded as including such equivalent construction insofar as they do not depart from the spirit and scope of the backpack with integrated pillow and poncho. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
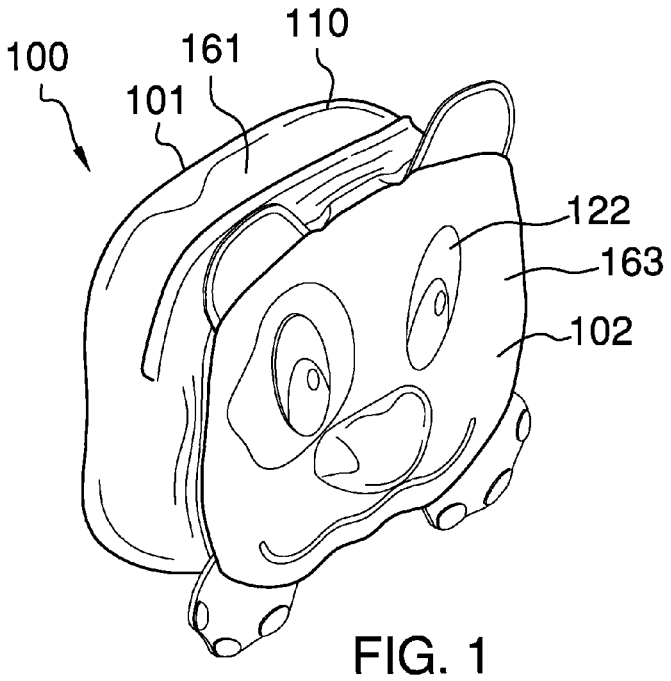
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The backpack with integrated pillow and poncho 100 (hereinafter invention) comprises a first panel 101, a second panel 102, a harness 103, a cape 104, a zipper 105, and a plurality of seams 106. The cape 104 is contained within a pouch 110 formed by the first panel 101 and the second panel 102. The harness 103 attaches to the first panel 101. The first panel 101, the second panel 102, the harness 103, and the cape 104 are all interconnected using the zipper 105 and the plurality of seams 106. The invention 100 is a travel article. The invention 100 is a backpack that converts into a cape 104. The invention 100 is a backpack that converts into a cushion. The cape 104 attaches to the backpack such that the backpack can continue to be worn while the cape 104 is also donned and being worn. The material used to form the cape 104 forms a padding material when the invention 100 is used as the cushion.

In the first potential embodiment of the disclosure, the first panel 101 is formed from a first sheeting material that is cut in a rectangular shape. The first panel 101 is further defined with a first surface 161, a second surface 162, a first edge 171, a second edge 172, a third edge 173, and a fourth edge 174.

In the first potential embodiment of the disclosure, the second panel 102 is formed from a second sheeting material that is cut in a rectangular shape. The second panel 102 is further defined with a third surface 163, a fourth surface 164, a fifth edge 175, a sixth edge 176, a seventh edge 177, and an eighth edge 178.

The third edge 173 of the first panel 101 and fifth edge 175 of the second panel 102 are joined such that: 1) the second surface 162 and the fourth surface 164 form a single surface; and, 2) the first surface 161 and the third surface 163 form a single surface. The first panel 101 and the second panel 102 fold around the joined third edge 173 and fifth edge 175 to form a pouch 110. The first panel 101 and the second panel 102 are folded such that the second surface 162 and the fourth surface 164 face each other to form the interior space of the pouch 110. The pouch 110 is enclosed using the zipper 105. The zipper 105 is a readily and commercially available product. The zipper 105 attaches the portion of the perimeter of the first panel 101 formed by the fourth edge 174, the first edge 171 and the second edge 172 to the portion of the perimeter of the second panel 102 formed by the eighth edge 178, the seventh edge 177 and the sixth edge 176. Specifically, the zipper 105 joins the eighth edge 178 to the fourth edge 174, the seventh edge 177 to the first edge 171, and the sixth edge 176 to the second edge 172.

The harness 103 comprises a first shoulder strap 111 and a second shoulder strap 112. The harness 103 is attached to the first surface 161 of the first panel 101 such that the invention 100 can be worn as a backpack. The first shoulder strap 111 and the second shoulder strap 112 are identical readily and commercially available shoulder straps intended for use with backpacks.

The cape 104 comprises a third sheeting 113. The third sheeting 113 is formed from a material selected from the group consisting of a plastic sheeting or a textile material. The center of the third sheeting 113 has formed in it an aperture 115. The aperture 115 is sized such that a head 131 can fit through the cape 104 thereby allowing the cape 104 to drape over the shoulders of the wearer.

Figure 7:
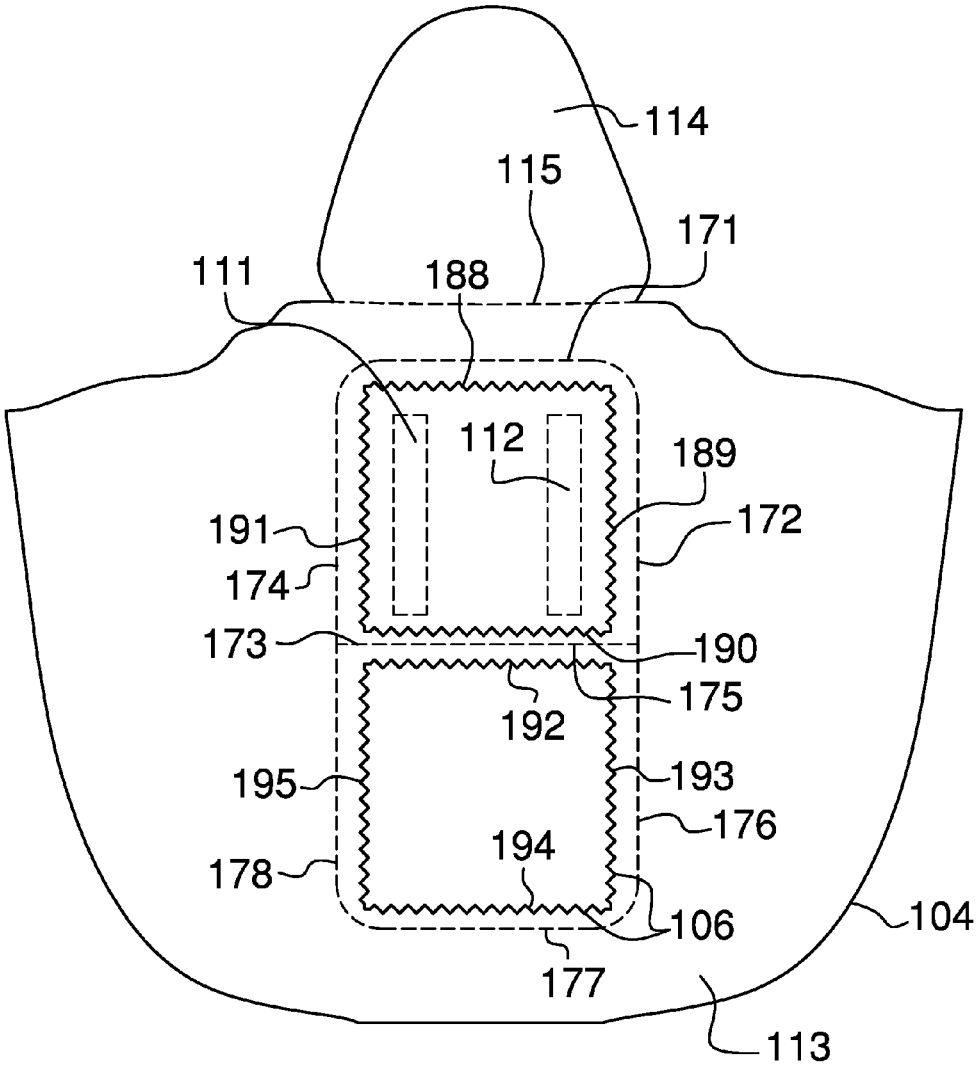
FIG. 7 is a detail view of an embodiment of the disclosure.

As shown most clearly in FIG. 7, the cape 104 attaches to the second surface 162 of the first panel 101 and the fourth surface 164 of the second panel 102 using one or more seams selected from the plurality of seams 106. The cape 104 is attached such that when the first panel 101 and the second panel 102 are unzipped, the second panel 102 will fall away from the first panel 101 thereby pulling the cape 104 down from behind the wearer. The wearer can simply pull the cape 104 over the head 131 in order to complete donning the cape 104.

The invention 100 is assembled as described in this paragraph. The plurality of seams 106 comprises a first seam 181, a second seam 182, a third seam 183, a fourth seam 184, a fifth seam 185, an sixth seam 186, a seventh seam 187, an eighth seam 188, a ninth seam 189, a tenth seam 190, a eleventh seam 191, a twelfth seam 192, a thirteenth seam 193, a fourteenth seam 194, and a fifteenth seam 195. The first seam 181 attaches the fifth edge 175 of the second panel 102 to the third edge 173 of the first panel 101. The second seam 182 attaches the zipper 105 to the fourth edge 174 of the first panel 101. The third seam 183 attaches the zipper 105 to the first edge 171 of the first panel 101. The fourth seam 184 attaches the zipper 105 to the second edge 172 of the first panel 101. The fifth seam 185 attaches the zipper 105 to the eighth edge 178 of the second panel 102. The sixth seam 186 attaches the zipper 105 to the sixth edge 176 of the second panel 102. The seventh seam 187 attaches the zipper 105 to the seventh edge 177 of the second panel 102. The eighth seam 188 attaches the cape 104 to the first panel 101 such that the eighth seam 188 is parallel to the first edge 171. The ninth seam 189 attaches the cape 104 to the first panel 101 such that the ninth seam 189 is parallel to the second edge 172. The tenth seam 190 attaches the cape 104 to the first panel 101 such that the tenth seam 190 is parallel to the third edge 173. The eleventh seam 191 attaches the cape 104 to the first panel 101 such that the eleventh seam 191 is parallel to the fourth edge 174. The twelfth seam 192 attaches the cape 104 to the second panel 102 such that the twelfth seam 192 is parallel to the fifth edge 175. The thirteenth seam 193 attaches the cape 104 to the second panel 102 such that the thirteenth seam 193 is parallel to the sixth edge 176. The fourteenth seam 194 attaches the cape 104 to the second panel 102 such that the fourteenth seam 194 is parallel to the seventh edge 177. The fifteenth seam 195 attaches the cape 104 to the second panel 102 such that the fifteenth seam 195 is parallel to the eighth edge 178.

In a second potential embodiment of the disclosure, the first panel 101 and the second panel 102 are formed from commercially available textile materials that are cut in a rectangular shape and treated with perfluorobutanesulfonic acid. Each of the plurality of seams 106 comprises a sewn seam.

Figure 2:
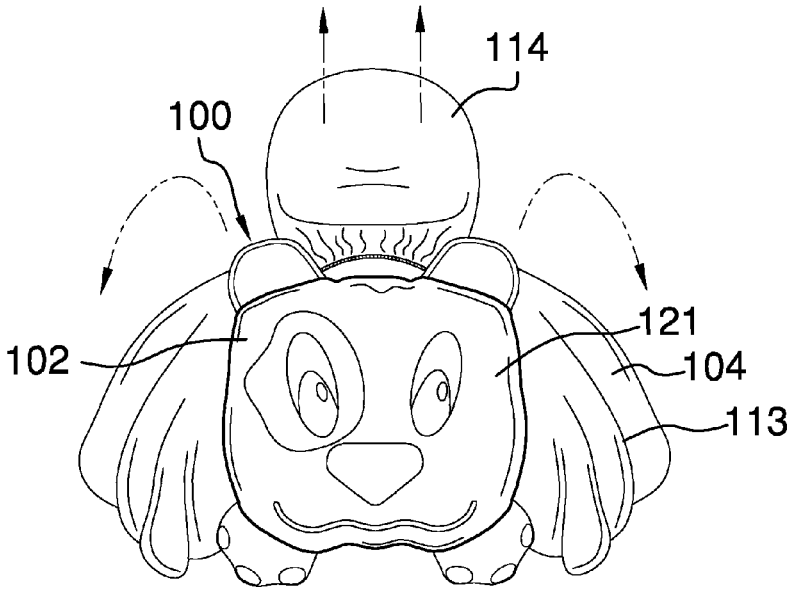
FIG. 2 is a front view of an embodiment of the disclosure.
Figure 3:
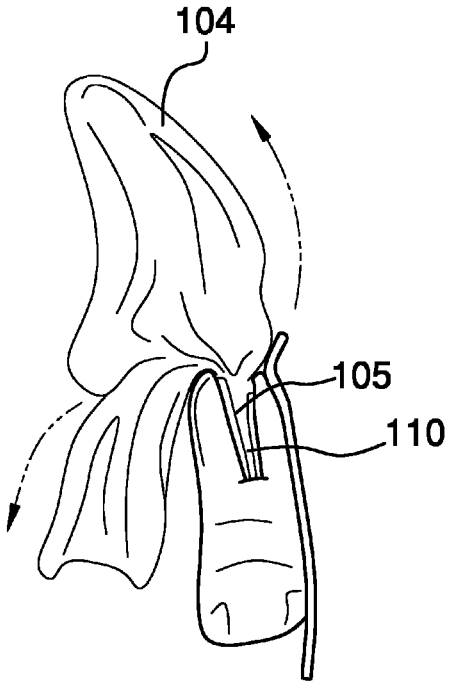
FIG. 3 is a side view of an embodiment of the disclosure.
Figure 4:
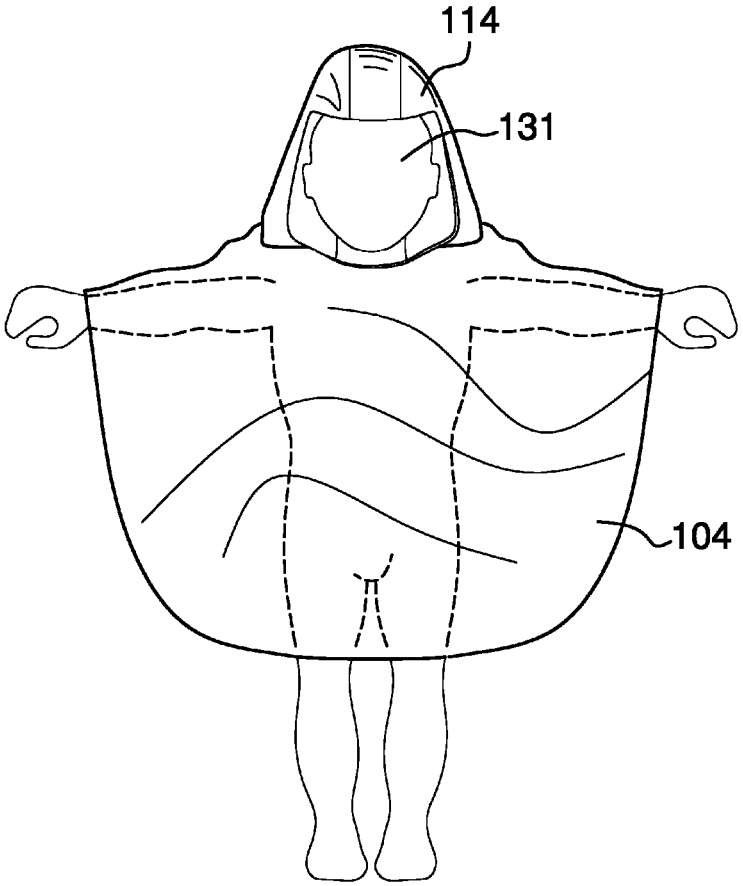
FIG. 4 is an in use view of an embodiment of the disclosure.
Figure 5:
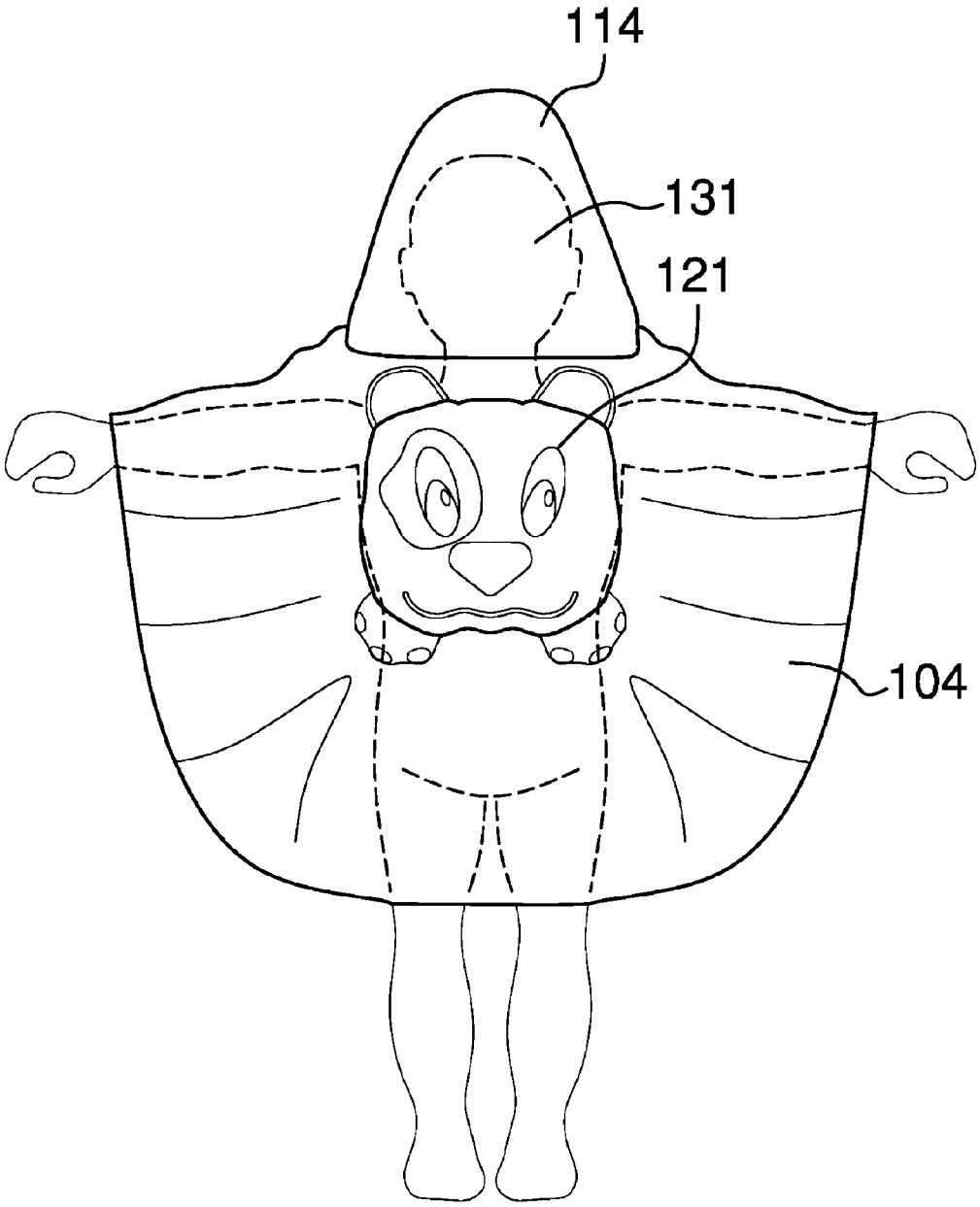
FIG. 5 is a reverse in use view of an embodiment of the disclosure.
Figure 6:
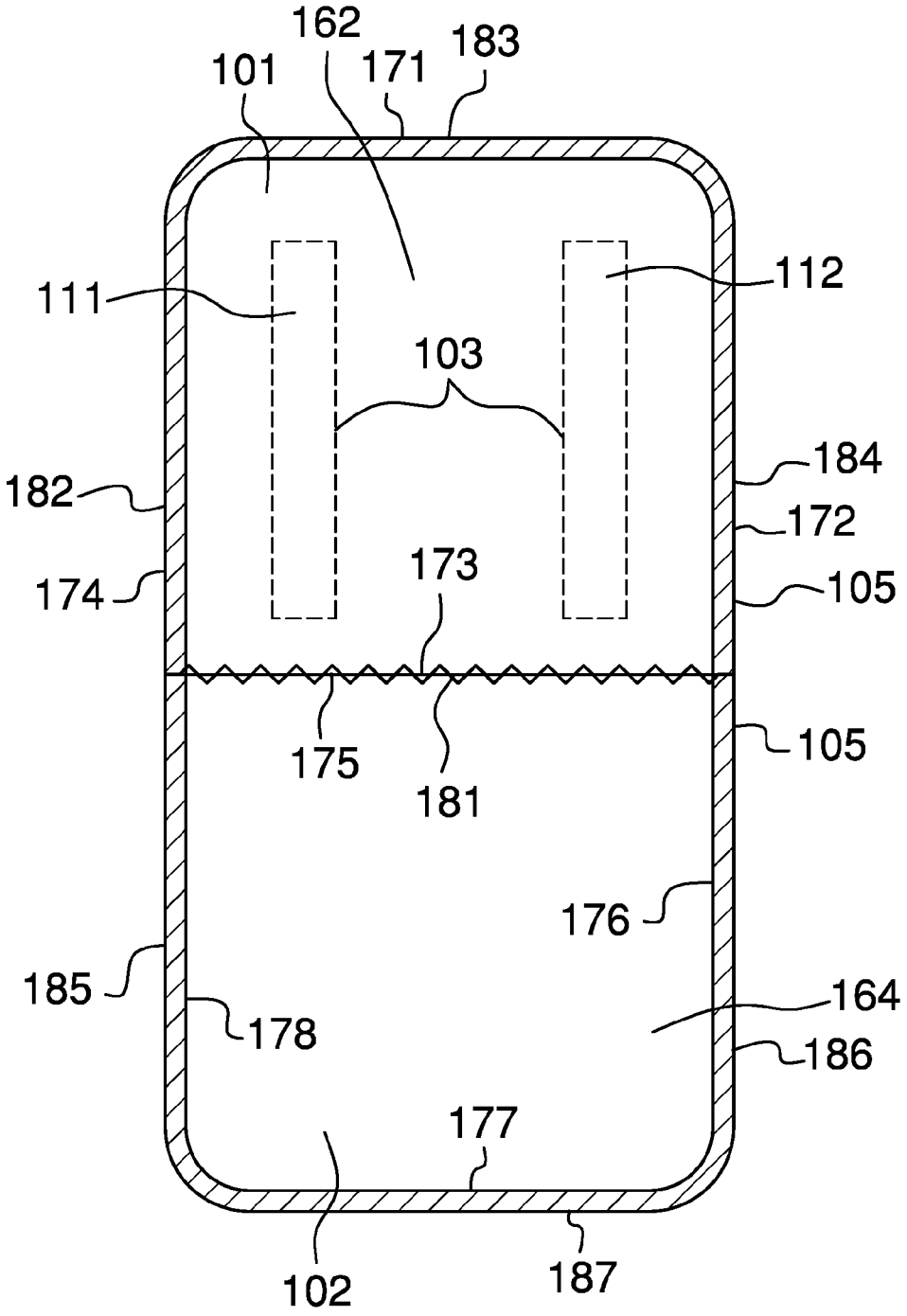
FIG. 6 is a detail view of an embodiment of the disclosure.

In a third potential embodiment of the disclosure, the invention 100 is customized for use by children by applying a first decorative emblem 121 and a second decorative emblem 122 to the invention 100. In this scenario, as shown most clearly in FIGS. 2 and 5, the first decorative emblem 121 and the second decorative emblem 122 are identical. The first decorative emblem 121 is applied to the second surface 162 of the first panel 101 such that the cape 104 is between the first decorative emblem 121 and the first panel 101 during application. As shown in FIG. 2, the second decorative emblem 122 is applied to the third surface 163 of the second panel 102. When the cape 104 is contained within the pouch 110 the second decorative emblem 122 is visible when the invention 100 is worn normally. When the cape 104 is deployed and worn normally, the first decorative emblem 121 is visible in what is effectively the same position as where the second decorative emblem 122 was placed.

In a fourth potential embodiment of the disclosure, the cape 104 further comprises a hood 114. The hood 114 is added to the aperture 115 in order to provide protection to the head 131 in inclement weather. Methods to attach hoods to capes to form ponchos are well known and documented in the textile and apparel arts.

To use the invention 100 as a cushion one simply loads the cape 104 into the pouch 110 and used the pouch 110 as the resting surface of a cushion.

The following definitions were used in this disclosure:

Backpack: As used in this disclosure, a backpack is an item of luggage that comprises a harness arrangement that allows the backpack to be carried on the back of a user. The harness arrangement commonly comprises a plurality of shoulder straps.

Cape: As used in this disclosure, a cape is a sleeveless garment that hangs from the shoulder and is used as outerwear. A cape may or may not have a hood.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Cushion: As used in this disclosure a cushion is a pad or pillow formed from soft material that is used for resting, sleeping, or reclining.

Decorative: As used in this disclosure, decorative is an adjective that refers to a first object or item that is used with a second object or item of the purpose of making the second object or item more attractive. Decorative will generally, but not necessarily, implies making the second object or item more attractive visually.

Drape: As used in this disclosure, to drape means to arrange in a fabric in flowing lines and folds.

Exterior: As used in this disclosure, the exterior is use as a relational term that implies that an object is not contained within the boundary of a structure or a space.

Harness: As used in this disclosure, a harness is an apparatus comprising a plurality of straps and one or more fasteners that is used to anchor a first person or first object to a second object.

Hood: As used in this disclosure, a hood is a portion of an outerwear garment that is intended to cover the head and neck of the wearer with an opening for the face.

Interior: As used in this disclosure, the interior is use as a relational term that implies that an object is contained within the boundary of a structure or a space.

Outerwear: As used in this disclosure, outerwear is clothing that incorporates a water resistant outer layer, or shell that is intended to be worn as the outer layer of clothing to protect the wearer from wet environmental conditions.

Pad: As used in this disclosure, a pad is a mass of soft material used as a filling or for protection against damage or injury.

Perfluorobutanesulfonic acid: As used in this disclosure, perfluorobutanesulfonic acid (CAS 375-73-5) is a surfactant, technically a fluorosurfactant, which is commonly applied to a textile as a water repellant.

Perimeter: As used in this disclosure, a perimeter is one or more curved or straight lines that bounds an enclosed area on a plane or surface. The perimeter of a circle is commonly referred to as a circumference.

Poncho: As used in this disclosure, a poncho is a cape with a hood.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, or an ultrasonically bonded seam.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, sheeting is a material, such as a textile, a plastic, or a metal foil, in the form of a thin flexible layer or layers.

Textile: As used in this disclosure, a textile is a material that is woven, knitted, braided or felted. Synonyms in common usage for this definition include fabric and cloth.

Zipper: As used in this disclosure, a zipper is a fastening device comprising two flexible strips with interlocking components that are opened and closed by pulling a slide along the two flexible strips.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A travel accessory comprising:

a first panel, a second panel, a harness, a cape, a zipper, and a plurality of seams;

wherein the cape is contained between the first panel and the second panel;

wherein the harness attaches to the first panel;

wherein the first panel, the second panel, the harness, and the cape are all interconnected using the zipper and the plurality of seams;

wherein the travel accessory is a travel article;

wherein the travel accessory is a backpack;

wherein the travel accessory converts into a cape;

wherein the cape fits over a head;

wherein the travel accessory converts into a cushion;

wherein the cape attaches to the backpack such that the backpack can continue to be worn while the cape is donned;

wherein the material used to form the cape forms a padding material;

wherein the padding material forms a cushion;

wherein the first panel is formed from a first sheeting material that is cut in a rectangular shape;

wherein the first panel is further defined with a first surface, a second surface, a first edge, a second edge, a third edge, and a fourth edge;

wherein the second panel is formed from a second sheeting material that is cut in a rectangular shape;

wherein the second panel is further defined with a third surface, a fourth surface, a fifth edge, a sixth edge, a seventh edge, and an eighth edge;

wherein the third edge of the first panel and fifth edge of the second panel are joined such that the second surface and the fourth surface form a single surface;

wherein the third edge of the first panel and fifth edge of the second panel are joined such that the first surface and the third surface form a single surface;

wherein the first panel and the second panel fold around the joined third edge and fifth edge to form a pouch;

wherein the first panel and the second panel are folded such that the second surface and the fourth surface face each other to form the interior space of the pouch;

wherein the pouch is enclosed using the zipper;

wherein the zipper attaches the portion of the perimeter of the first panel formed by the fourth edge, the first edge and the second edge to the portion of the perimeter of the second panel formed by the eighth edge, the seventh edge and the sixth edge.

2. The travel accessory according to claim 1 wherein the harness comprises a first shoulder strap and a second shoulder strap;

wherein the harness attaches to the first surface of the first panel such that the travel accessory can be worn as a backpack.

3. The travel accessory according to claim 2
wherein the cape comprises a third sheeting;
wherein the third sheeting is formed from a material selected from the group consisting of a plastic sheeting or a textile material.

4. The travel accessory according to claim 3
wherein the center of the third sheeting has formed in it an aperture;
wherein the aperture is sized such that a head can fit through the cape.

5. The travel accessory according to claim 4 wherein the cape attaches to the second surface of the first panel and the fourth surface of the second panel.

6. The travel accessory according to claim 5 wherein the cape is attached such that when the first panel and the second panel are unzipped, the second panel will fall away from the first panel thereby pulling the cape down.

7. The travel accessory according to claim 6
wherein the plurality of seams comprises a first seam,
wherein the first seam attaches the fifth edge of the second panel to the third edge of the first panel.

8. The travel accessory according to claim 7
wherein the plurality of seams comprises a second seam, a third seam, a fourth seam, a fifth seam, an sixth seam, a seventh seam,
wherein the first seam attaches the fifth edge of the second panel to the third edge of the first panel;
wherein the second seam attaches the zipper to the fourth edge of the first panel;
wherein the third seam attaches the zipper to the first edge of the first panel;
wherein the fourth seam attaches the zipper to the second edge of the first panel;
wherein the fifth seam attaches the zipper to the eighth edge of the second panel;
wherein the sixth seam attaches the zipper to the sixth edge of the second panel;
wherein the seventh seam attaches the zipper to the seventh edge of the second panel.

9. The travel accessory according to claim 8
wherein the plurality of seams comprises an eighth seam, a ninth seam, a tenth seam, a eleventh seam, a twelfth seam, a thirteenth seam, a fourteenth seam, and a fifteenth seam;
wherein the eighth seam attaches the cape to the first panel such that the eighth seam is parallel to the first edge;
wherein the ninth seam attaches the cape to the first panel such that the ninth seam is parallel to the second edge;
wherein the tenth seam attaches the cape to the first panel such that the tenth seam is parallel to the third edge;
wherein the eleventh seam attaches the cape to the first panel such that the eleventh seam is parallel to the fourth edge;
wherein the twelfth seam attaches the cape to the second panel such that the twelfth seam is parallel to the fifth edge;
wherein the thirteenth seam attaches the cape to the second panel such that the thirteenth seam is parallel to the sixth edge;
wherein the fourteenth seam attaches the cape to the second panel such that the fourteenth seam is parallel to the seventh edge;
wherein the fifteenth seam attaches the cape to the second panel such that the fifteenth seam is parallel to the eighth edge.

10. The travel accessory according to claim 9 wherein the zipper joins the eighth edge to the fourth edge, the seventh edge to the first edge, and the sixth edge to the second edge.

11. The travel accessory according to claim 10
wherein the first panel is formed a textile treated with perfluorobutanesulfonic acid;
wherein the second panel is formed a textile treated with perfluorobutanesulfonic acid.

12. The travel accessory according to claim 11 wherein the cape further comprises a hood.

13. The travel accessory according to claim 12 wherein each of the plurality of seams comprises a sewn seam.

14. The travel accessory according to claim 10
wherein the travel accessory further comprises a first decorative emblem and a second decorative emblem to the travel accessory;
wherein the first decorative emblem and the second decorative emblem are identical;
wherein the first decorative emblem is applied to the second surface of the first panel such that the cape is between the first decorative emblem and the first panel during application;
wherein the second decorative emblem is applied to the third surface of the second panel;
wherein when the cape is contained within the pouch the second decorative emblem is visible;
wherein when the cape is deployed the first decorative emblem is visible.

15. The travel accessory according to claim 14 wherein the cape further comprises a hood.

16. The travel accessory according to claim 15
wherein the first panel is formed a textile treated with perfluorobutanesulfonic acid;
wherein the second panel is formed a textile treated with perfluorobutanesulfonic acid;
wherein each of the plurality of seams comprises a sewn seam.

* * * * *